US005779227A

United States Patent [19]

Elkins et al.

[11] Patent Number: 5,779,227

[45] Date of Patent: Jul. 14, 1998

[54] CROWD CONTROL BARRIER

[76] Inventors: R. Wayne Elkins, 5016 S. Georgia Place, Oklahoma City, Okla. 73129; Lance K. Childers, 1509 Padova, Las Vegas, Nev. 89117; Randal S. Hardcastle, 5016 S. Georgia Place, Oklahoma City, Okla. 73129

[21] Appl. No.: 806,273

[22] Filed: Feb. 25, 1997

[51] Int. Cl.[6] ..... E04H 17/16

[52] U.S. Cl. ..... 256/31; 256/24; 256/26

[58] Field of Search ..... 256/24, 31, 30, 256/25, 26, 1, 64, 59, 35

[56] References Cited

U.S. PATENT DOCUMENTS

| | | | |
|---|---|---|---|
| 2,709,073 | 5/1955 | Dougherty | 256/24 |
| 3,204,606 | 9/1965 | Parr et al. | 256/26 X |
| 3,767,167 | 10/1973 | Rasmussen | 256/24 X |
| 3,770,246 | 11/1973 | Key | 256/26 X |
| 3,815,877 | 6/1974 | Turner | 256/24 |
| 4,174,096 | 11/1979 | Campbell | 256/24 |
| 5,213,312 | 5/1993 | MacDonald | 256/26 |
| 5,356,119 | 10/1994 | Schock | 256/26 |
| 5,362,030 | 11/1994 | Iler, Jr. et al. | 256/26 X |

FOREIGN PATENT DOCUMENTS

| | | | |
|---|---|---|---|
| 3412354 | 10/1985 | Germany | 256/1 |
| 94/19545 | 9/1994 | WIPO | 256/1 |

*Primary Examiner*—Harry C. Kim
*Attorney, Agent, or Firm*—Robert K. Rhea

[57] ABSTRACT

A crowd control barrier is formed by a plurality of congruent rectangular fence panels joined end to end by pins in a plurality of sleeves secured to panel end posts in axi-ally aligned vertically staggered relation. A knee brace secured to adjacent panel end posts by cooperating knee brace sleeves stabilizes the barrier in cooperation with a base platform hingedly connected longitudinally with each fence panel opposite the knee brace on which pedestrians stand when adjacent the fence panels.

1 Claim, 2 Drawing Sheets

CROWD CONTROL BARRIER

BACKGROUND OF THE INVENTION

This invention relates to fences and more particularly to modular fence panels for forming a crowd control barrier.

A self supporting easily erected and dismantled fence or barrier is needed to control the flow of pedestrian traffic or for the safety of a crowd or the contestants at a sporting event. This invention provides such a fence or barrier by forming a plurality of substantially congruent fence panels joined in substantially end to end relation and braced to prevent wind or a crowd tipping the fence in either direction.

BRIEF SUMMARY OF THE INVENTION

A modular fence forming panel is formed by a pair of upright parallel posts connected at their respective ends by longitudinally extending top and bottom rails and a third brace rail intermediate the length of the posts which forms a frame having fence fabric attached to one of its sides. Brace members projecting laterally of the panel maintains it in upright position on substantially any supporting surface without the necessity of forming post holes or driving posts into the surface of the earth. A plurality of such modular fence panels form a fence or barrier when connected together in end to end relation. The frame end posts are provided with a plurality of vertically spaced axially aligned sleeves on its surfaces opposite the fence fabric. The fence panel supporting brace similarly comprises an upright standard rigidly joined in orthogonal relation to one end of a brace base with a diagonal brace extending between the brace standard and the brace base. The brace standard is normally disposed adjacent the juncture of panels. The brace standard is similarly provided with a plurality of sleeves cooperatively spaced with respect to the above named sleeves on the panel end posts and in axial alignment therewith for cooperatively receiving pins projecting through the respective vertically aligned sleeves for preventing separation of adjacent panel ends and from the base standard. The modular panel is further provided with a base platform hingedly connected by one longitudinal edge with the base rail below the fence fabric.

The principal objects of this invention are to provide: a fence or barrier forming modular panel easily connected in fence forming relation by unskilled labor; which may be erected on any substantially flat surface without inserting depending ends of posts into the surface of the earth; and, which may be easily disassembled for transportation or storage.

DETAILED DESCRIPTION OF THE INVENTION

Figure 1:
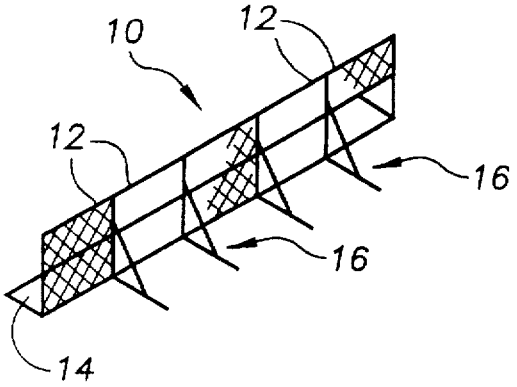
FIG. 1 is a thumbnail perspective view of a preferred embodiment of a section of fence formed by modular fence panels.

Like characters of reference designate like parts in those figures of the drawings in which they occur.

Figure 3:
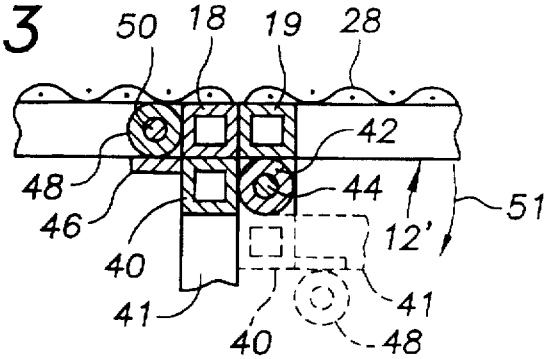
FIG. 3 is a horizontal sectional view, to a further enlarged scale, taken substantially along the line of 3—3 of FIG. 2.
Figure 2:
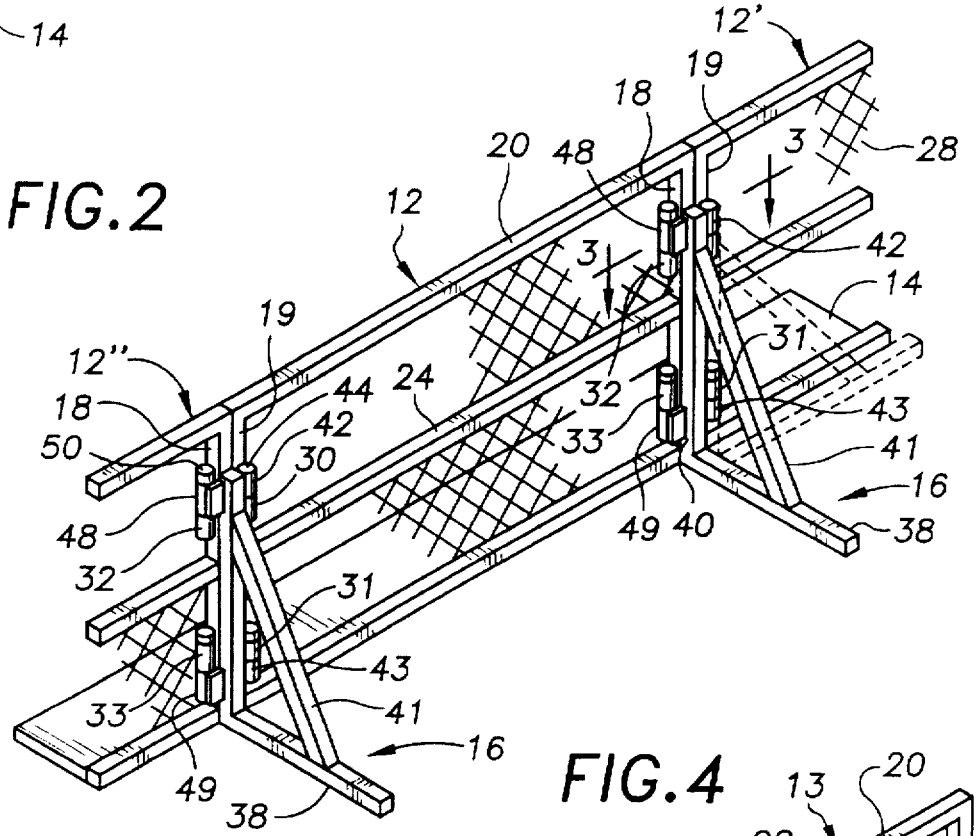
FIG. 2 is a fragmentary perspective view to a larger scale, of a modular fence panel connected with fragmentary end portions of adjacent panels in fence forming position.
Figure 4:
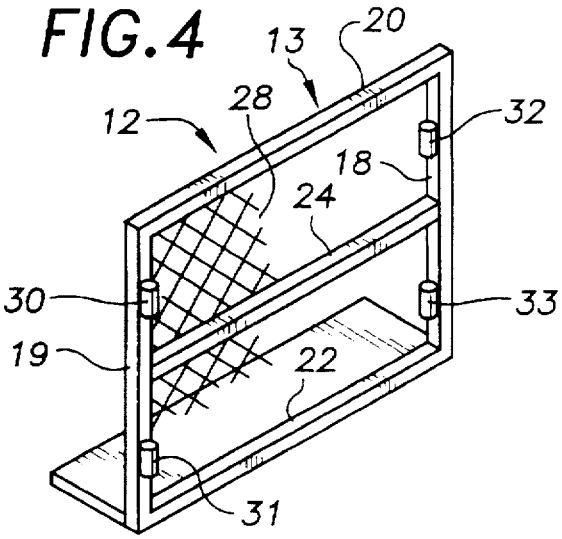
FIG. 4 is a perspective view of one modular fence panel, per se.
Figure 5:
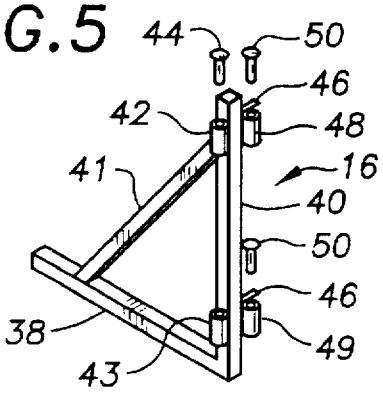
FIG. 5 is a perspective view of one of one fence brace.

In the drawings:

Referring first to FIGS. 1–5, the reference numeral 10 indicates a section of fence formed by a plurality of rectangular substantially congruent modular fence panels 12 maintained in end butting longitudinally aligned upstanding relation by base platforms 14 and brace means 16. FIG. 2 illustrates a modular panel 12 and adjacent end portions of identical panels 12' and 12". Since the panels are substantially congruent only the panel 12 of FIGS. 2 and 4 is described in detail.

The panel 12 comprises an open rectangular frame 13 having a pair of parallel frame end posts 18 and 19 connected at their respective ends with longitudinally extending parallel upper and lower rails 20 and 22 with a longitudinal brace 24 extending between the end members 18 and 19 substantially medially their ends. The frame 13 in the example shown is formed from tubular material preferably square in cross section but obviously the frame members 18 through 24 may comprise rod members or tubular members of other cross sectional configuration if desired.

The substantially rectangular base platform 14 is hingedly connected by one longitudinal edge to one side of the lower rail 22. The purpose of the base platform is to prevent pedestrians standing on the base platform from pushing the upper portion of the modular fence panels in a direction opposite the base panel. A section of hardware cloth or fence fabric 28, such as chain link fencing coextensive with the length and width of the modular panel 12 is secured to its surface on that side of the frame 13 having the base platform secured thereto. A pair of sleeves 30 and 31 of selected diameter end length are secured in vertically spaced axially aligned relation to the frame end member 19 on its surface opposite the fence fabric 28 for the purposes presently believed apparent. A second pair of similar sleeves 32 and 33 are secured in vertically spaced axially aligned relation above and below the frame horizontal brace 24 and within the frame on that surface of the frame end member 18 confronting the opposite frame end member 19.

The brace means 16 comprises a base member 38 orthogonally connected at one end to the depending end of a standard 40 which abuts the surface of the frame end member 18 on the side opposite the fence fabric 28. A knee brace 41 extends angularly between and is rigidly connected at its respective ends between the upright standard 40 and the base member 38. A third pair of similar sleeves 42 and 43 are similarly connected to one side surface of the standard 40 above or below the pair of sleeves 30 and 31, on the frame end post 19 of the adjacent panel 12', in axial alignment therewith for receiving sleeve connector pins 44. A pair of wings 46 are secured to the side of the standard 40 opposite the sleeves 42 and 43 in cooperative vertically spaced axially aligned relation with respect to the sleeves 32 and 33 on the frame end member 18. A fourth pair of similar sleeves 48 and 49 are rigidly secured to the wings 46 above or below the respective sleeves 32 and 33 and in axial alignment therewith for receiving a second pair of pins 50 thus rigidly securing the brace means 16 to the fence panels 12 and 12' and securing the fence panels in end abutting relation.

If desired, the direction of the fence panel 12' relative to the panel 12 may be angularly changed as by rotating the panel 12' about the vertical axis of the pins 44 as illustrated by the arrow 51 (FIG. 3). The modular fence panels are disassembled by simply removing the hinge pins 44 and 50 to separate the brace means 16 from the fence panels. For moving or storage of the panel 12 the base platform 14 is pivoted upwardly against the surface of the fence fabric 28. If desired, only the hinge pins 50 may be removed and the brace means 16 pivoted toward the adjacent side of the panel 12' as illustrated by dotted lines (FIG. 2).

Figure 8:
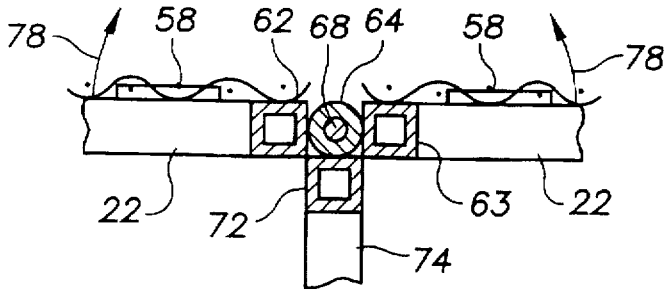
FIG. 8 is a horizontal sectional view to a different scale taken substantially taken along the line 8—8 of FIG. 6.
Figure 7:
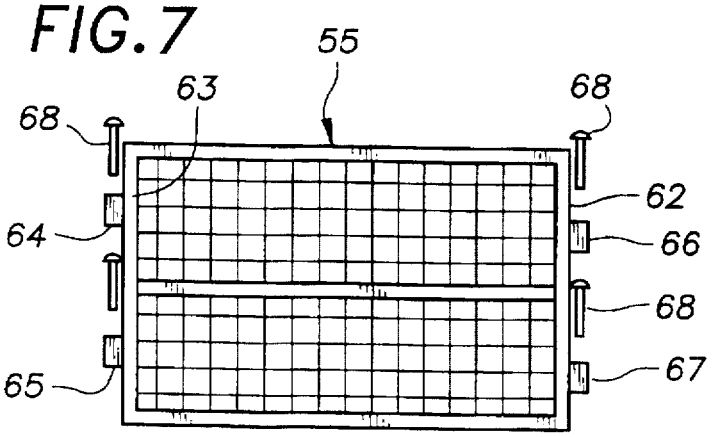
FIG. 7 is a side elevational view of one of the fence panels of FIG. 6.
Figure 6:
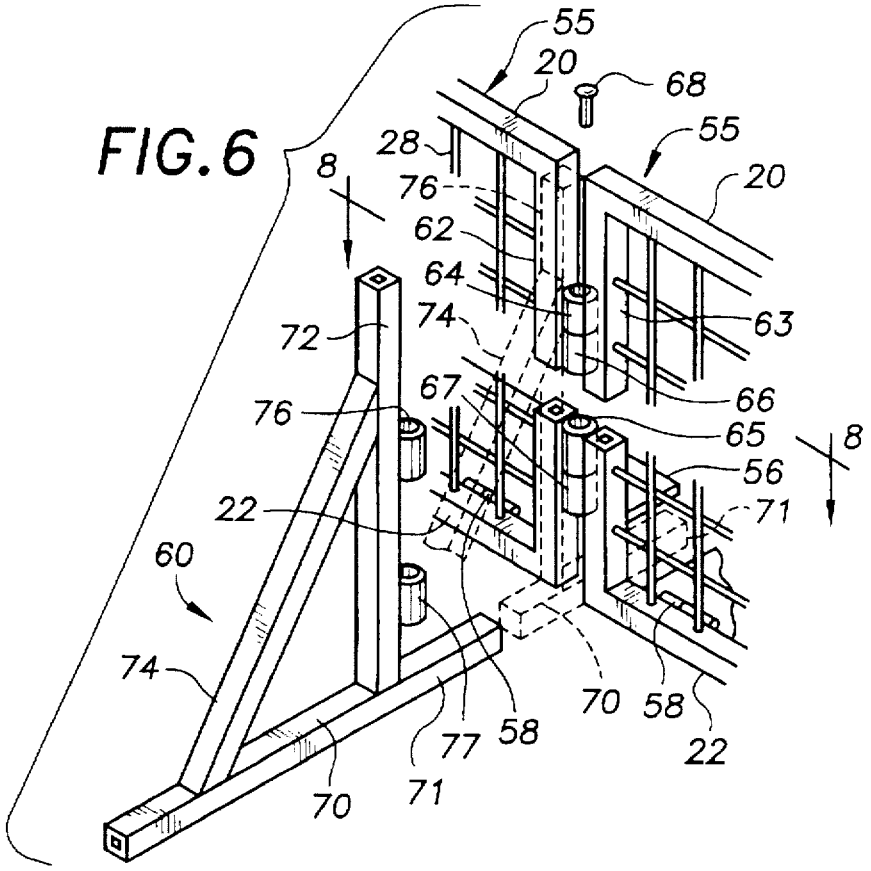
FIG. 6 is an fragmentary exploded perspective view of a second embodiment, illustrating by dotted lines, the fence brace in operative position.

Referring also to FIGS. 6–8 the reference numeral 55 indicates similar substantially congruent fence panels forming a second embodiment of the invention. The principal difference between the modular fence panels 55 and the fence panels 12 is the placement and disposition of the sleeves connecting the panels in end to end relation and connecting the laterally projecting brace means with the panels. Each of the panels 55 are provided with a base platform 56 similarly hingedly connected with the base rail of the respective panel by hinge means 58 for vertical pivoting movement toward and away from the adjacent side surface of the respective panel. The panel end member 63 is provided with a fifth pair of sleeves 64 and 65 connected in vertically spaced relation to the end surface of the frame panel end member 63 opposite its other end member 62. The frame end member 62 is provided with a sixth pair of sleeves 66 and 67 connected with the end surface of the frame member 62 opposite the end member 63 in vertically spaced relation so that the top ends, as viewed in FIG. 7, of the sleeves 66 and 67 abut the bottom or lower surface of the pair of sleeves 64 and 65 for receiving a hinge pin 68 when the adjacent ends of two panels 55 are disposed with the axes of the fifth and sixth pairs of sleeves in vertically aligned relation.

A brace means 60 similar to the brace means 16 is connected with adjacent frame end posts of panels 55 in a similar manner. The brace means 60 is formed by a base member 70 having an upright standard 72 connected to base member 70 adjacent one of its end portions 71. The end portion 71 projects through the spacing formed by the superposed pairs of sleeves when adjacent ends of the panels 55 are connected by the pins 68 to form a brace preventing the panels 55 being vertically pivoted about the horizontal axis of the base platform hinges 58 in a direction opposite the brace means 60. The brace standard 72 is similarly provided with a vertically disposed axially aligned seventh pair of sleeves 76 and 77 secured to the surface of the standard 72 opposite the knee brace 74 to cooperatively underlie the depending ends of the panel end member sleeves 66 and 67 and be secured by the depending end portion of the hinge pins 68.

Referring more particularly to FIG. 8 either one of the adjacent panels 55 may be angularly rotated about the axis of the hinge pin 68 in the direction of the arrows 78 to change the direction of the fence being erected. It seems obvious that the fence formed by the modular panels 55 can be disassembled by simply removing the hinge pins 68 which permits separating the brace means from the adjacent ends of the panels and similarly separating the panels.

Obviously the invention is susceptible to changes or alterations without defeating its practicability. Therefore, we do not wish to be confined to the preferred embodiments shown in the drawings and described herein.

I claim:

1. The crowd control barrier, comprising:

a plurality of elongated rectangular substantially congruent modular fence panels having end posts disposed in panel end abutting relation with respective adjacent fence panels;

each panel of said plurality of panels comprising:

an open frame having upright parallel tubular posts forming frame end members and having longitudinal upper and lower tubular rails respectively connected at respective ends with the ends of said posts;

a coextensive section of fence fabric having marginal edge portions secured to perimeter portions of said frame;

a base platform having a longitudinal edge longitudinally hingedly secured to the lower rail of each said fence panel on the fence fabric side thereof;

a first plurality of sleeves secured in vertically spaced axially aligned relation to one said post on its surface opposite said fence fabric;

a second plurality of sleeves secured in vertically spaced axially aligned relation to the other said post within said frame on the surface of the other said post confronting said one post;

knee brace means including a standard adjacent the surfaces of said abutted fence panel end posts opposite the fence fabric;

said knee brace means comprising:

a base member orthogonally connected with the depending end of said standard and protecting opposite the base platform on the respective said fence panel;

a knee brace extending between said base member and said standard;

other sleeves secured to said standard adjacent and in cooperative vertically spaced axial alignment with said first and said second plurality of sleeves; and, pins axially extending through said adjacent axially aligned sleeves of said standard and said posts.

* * * * *